US005190087A

United States Patent [19]

Mike

[11] Patent Number: 5,190,087

[45] Date of Patent: Mar. 2, 1993

[54] WOOD CUTTING AND SPLICING APPARATUS

[76] Inventor: Fred Mike, 12210 Hillside La., Louisville, Ky. 40299

[21] Appl. No.: 901,861

[22] Filed: Jun. 22, 1992

[51] Int. Cl.[5] ..... B27F 1/06

[52] U.S. Cl. ..... 144/91; 144/90 R; 144/2 R; 83/140; 83/460; 83/347

[58] Field of Search ..... 83/140, 460, 461; 144/2 R, 90 R, 90 A, 91, 347, 363

[56] References Cited

U.S. PATENT DOCUMENTS

| | | | |
|---|---|---|---|
| 3,842,645 | 10/1974 | Stevens et al. | 83/140 |
| 4,057,088 | 11/1977 | Gross et al. | 144/91 |
| 4,103,574 | 9/1978 | Greer | 83/140 |
| 4,742,742 | 5/1988 | Yokoe | 83/140 |

*Primary Examiner*—W. Donald Bray
*Attorney, Agent, or Firm*—Charles G. Lamb; James C. Eaves, Jr.

[57] ABSTRACT

An apparatus for cutting and splicing sheets of wood veneer includes two pairs of dies is in opposed cooperating relationship with spacing between the pairs of dies sufficient to receive at least two sheets of wood veneer in an overlapping relation therebetween. In each pair of dies, one die in opposed cooperating relationship with the other die, and one die in each pair is transversely moveable, serving as a holding die, and the other die in each pair is stationary in relation thereto and serves as a cutting die. Means are also provided to move the dies so that upon movement of the dies the overlapping sheets of material are cut and spliced in one operation.

11 Claims, 1 Drawing Sheet

WOOD CUTTING AND SPLICING APPARATUS

BACKGROUND OF THE INVENTION

The present invention relates to an apparatus for cutting wood and more particularly, to an apparatus which, in a single stage operation, cuts the ends of thin sheets of wood veneer and splices the cut sheets.

In the manufacture of wall coverings made of wood veneers, and the like, sheets of wood veneer are cut so they can easily be spliced end-to-end and then rolled for further use. One of the two most common means of making these wood veneer rolls is to first cut sheets of wood veneer using appropriate cutting dies, into what is referred to as "flame-cut" or "finger joint cuts" and then piecing the sheets together, manually. In the cutting of the wood veneer, a "flame cut" piece is one wherein the cut resembles a flame and in a "finger joint cut" piece, all of the longitudinally extending cut portions of the wood are of the same length and shape. With both, the "flame cut" and "finger joint cut", similar cut pieces can be fitted together wherein the longitudinally extending portions of the cut of one piece fit in the corresponding spacings between the longitudinally extending portions of the piece.

In one prior art means for cutting and splicing, one female die and one male die are utilized, wherein the dies are transversely spaced apart with one of the dies being moveable and the other being stationary, whereby the moveable die moves in and out of mating relation with the stationary die. The spacing between the dies is sufficient for receiving a sheet of wood veneer therebetween. In cutting, each end of the wood veneer sheets are cut and the sheets are manually joined or fitted together. An adhesive tape-type material is placed along the joints of the pieces of wood veneer, on the back side thereof. The joints on the front or face of the joined pieces are then sanded. Upon applying numerous coats of coating materials to the face surface, the joint becomes substantially unnoticeable.

In a second means of cutting and splicing, a single machine is utilized, but in this machine there are two pairs of dies, in longitudinal spaced relation with each other. In the cutting operation, two sheets of wood veneer are laid end-to-end with spacing between the ends. One pair of dies cuts the end of one sheet of wood veneer and the other set of dies cuts the adjacent end of the other sheet. After the cutting operation, a stripper removes the excess pieces of wood at the end of each piece and a third operation is performed whereby pushing means are used to force the two cut ends together.

However, in both of the present means of joining wood veneer sheets, as discussed above, "pin holes" result in the juncture. These "pin holes" are the small holes in the joint formed at the terminating ends of the "fingers" or "flames". These "pin holes" are caused because the wood swells slightly as it is cut. The time from "cut" to "splice", even if only a very short period, such as the time delay between the stripping of the wood from the cut ends and the forcing of the two joints together, is a sufficient time for the wood to swell. This swelling, prior to the joining or splicing creates a situation where the cut is not exact and the terminating ends connecting with the adjacent piece leaves these tiny "pin" holes.

SUMMARY OF THE INVENTION

It is an object of the present invention to provide an apparatus which cuts and splices wood veneer with or without backing, in one step. It is another object of the present invention to provide a cutting and splicing machine which substantially eliminates pin holes in the juncture of interconnected wood veneer sheets. It is still another object of the present invention to provide an apparatus for cutting and splicing sheets of wood veneer that is more efficient and economical over those present commercially available.

More particularly, the present invention provides an apparatus for cutting and splicing sheets of wood veneer comprising: a support assembly for two pairs of dies and means to move the dies in a cutting and splicing relationship with each other; a first pair of dies in opposed cooperating relation, a first die being a holding die and being transversely moveable within a second die, said second die being a cutting die and being stationary in relationship with said first die; a second pair of dies in opposed cooperating relation, a third die being a holding die and being transversely moveable within a fourth die, said fourth die being a cutting die and being stationary in relationship with said third die; said first and second pair of dies being mounted in spaced parallel relationship, said first pair of dies being transversely moveable toward said second pair of dies; a spacing between said first and second pairs of dies that is of sufficient thickness to receive at least two sheets of wood veneer material disposed in overlapping relationship therebetween; and means to move the dies in a cutting and splicing relationship with each other.

It is to be understood that various changes can be made by one skilled in the art, in arrangement, form, and construction of the dies of the present invention without departing from the scope or spirit of the invention.

BRIEF DESCRIPTION OF THE DRAWING

Referring to the drawing.

DETAILED DESCRIPTION OF THE PREFERRED EMBODIMENT

The Figures show an apparatus, identified by the numeral 10, which is a preferred cutting and splicing apparatus of the present invention. Apparatus 10 cuts and splices two sheets of wood veneer 12 in one step to produce multiple sheet 16 having juncture 18 substantially void of pin holes. Residue 14 is discarded by means not shown, which may include, for example, manual means or automated means.

Figure 1:
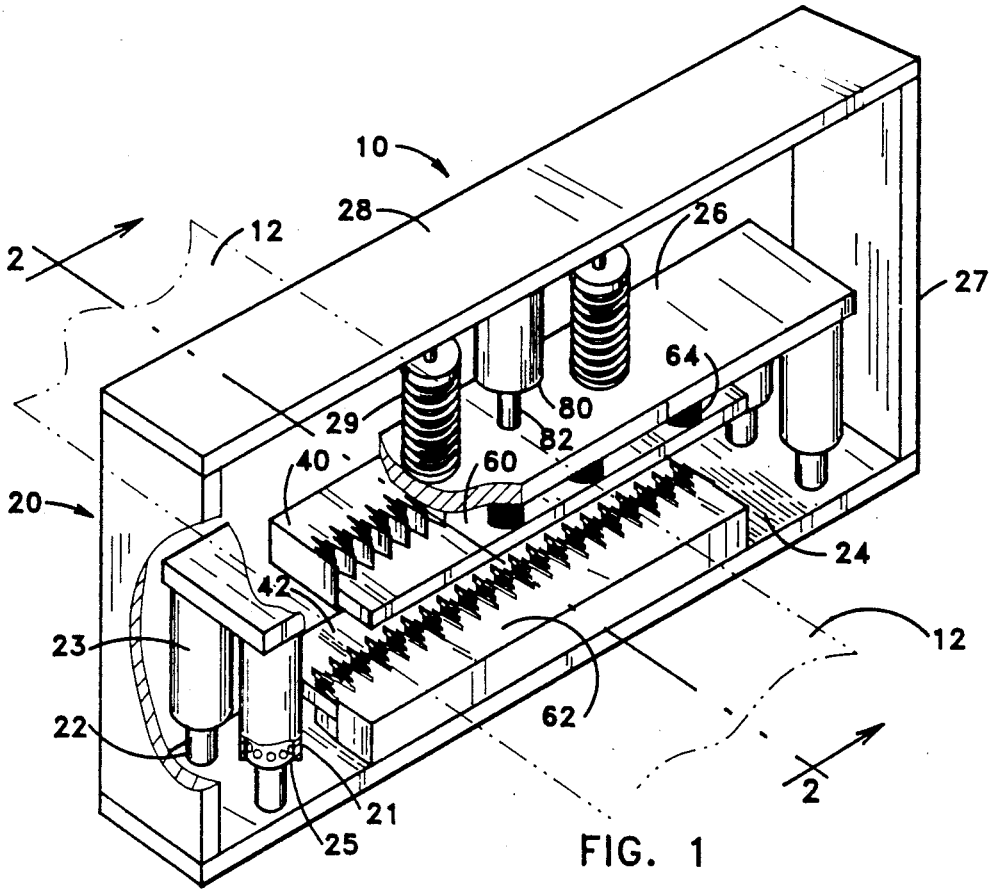
FIG. 1 is a perspective view, with selected portions cut-away, of one preferred embodiment of a wood cutting and splicing apparatus of the present invention.

Support assembly 20 provides proper alignment of the two pairs of cutting dies 40,60 and 42,62, while stationary and while performing the cutting and splicing operation. Support assembly 20 includes a plurality of die guide assemblies 21. Die guide assemblies 21 include stationary cylinders 22 which are attached to a stationary lower die shoe 24, each stationary cylinder 22 received within a cylinder 23, which is attached to an upper die shoe 26. Cylinders 23 slide in response to movement of a piston rod 82 controlled by piston 80, as explained hereinafter. The outer diameter of cylinder 22 is approximately equal to or slightly less than the inner diameter of a cylinder 23. Bearings or the like may be included within die guide assembly 21 to facilitate the sliding relationship between cylinders 22 and 23. For example, as shown in a cutaway portion of cylinders 22,23 of FIG. 1, a sleeve containing ball bearings 25 is inserted between cylinders 22,23. A top support 28 holds piston 80 at a proper position. Top support 28 is supported by side supports 27. Upper die shoe 26 and lower die shoe 24 are in a movable parallel alignment. Die guide assembly 21 facilitates this movable parallel alignment as piston rod 82 moves shoes 24 and 26 toward each other. Springs 29, connected between top support 28 and top shoe 26, move shoes 24 and 26 away from each other when piston 80 is inactive.

A first pair of dies 40, 60 are in an opposed cooperating relation. First die 60 is connected to upper die shoe 26 by springs 64, which serve as a biasing means, and is therefore transversely movable within second die 40, which is connected directly to upper die shoe 26. First die 60 serves as a holding die and second die 40 serves as a cutting die, as will be explained hereinafter.

A second pair of dies 42, 62 are in an opposed cooperating relation. Third die 42 is connected to lower die shoe 24 by a plurality of springs 44, which serve as a biasing means, and is therefore movable within fourth die 62, which is connected directly to lower die shoe 24. Third die 42 serves as a holding die and fourth die 62 serves as a cutting die, as will be explained hereinafter.

In a non-cutting position, dies 40 and 60 intermesh, with die 60 being positioned closer to shoe 24, a distance at least equal to the thickness of one sheet of veneer 12. Further, die 60 is at least a distance equal to the thickness of two sheets of veneer 12 from the fourth die 62, so that two veneer sheets 12 can be received therebetween. The most common commercially available veneer presently marketed has a thickness around about 0.015" (0.038 cm). In a non-cutting position, dies 42 and 62 intermesh, with die 62 being closer to shoe 26, a distance equal to the thickness of about one sheet of veneer. This spacing serves to ensure proper alignment of the spliced multiple sheet 16 and residue pieces 14 when two sheets of veneer 12 are cut and spliced.

Means to move dies 40 and 60 downward to perform a cutting and splicing operation is provided by piston 80, held in a fixed position by top support 28, and piston rod 82 which extends from piston 80 and is connected to top shoe 26. Springs 29 maintain dies 40,60 and 42,62 in a non-cutting position, that being dies 60,62 being spaced apart a distance at least equal the thickness of two sheets of veneer, except when piston 80 is activated to perform a cutting and splicing operation.

Figure 2:
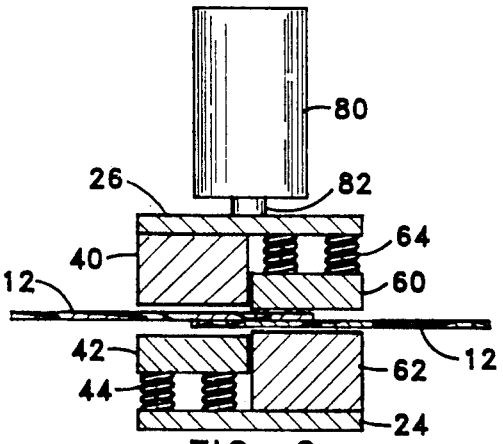
FIG. 2 is a cross-sectional view of the apparatus of FIG. 1 as shown along the lines 2—2 of FIG. 1 showing two sheets of wood veneer in an overlapping relationship prior to cutting.
Figure 3:
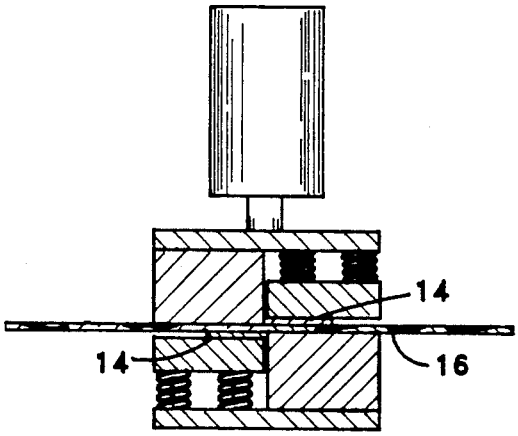
FIG. 3 is the same cross-sectional view as FIG. 2 but with the dies in a cutting position for the two sheets of wood veneer; and, FIG. 4 is a plan view of two sheets of wood veneer which have been cut and spliced by the apparatus of FIG. 1.
Figure 4:
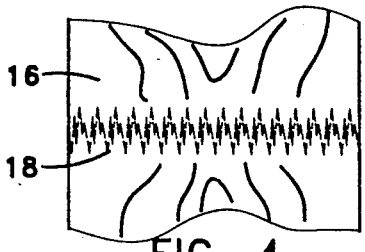

In operation, the ends of two sheets of veneer 12 are placed between dies 40,60 and dies 42,62 in an overlapping arrangement as shown in FIG. 2. Piston 80 is then engaged to move piston rod 82, and therefore upper die shoe 26 and dies 40,60, downward to cut veneer sheets 12 as guided by die guide assemblies 21. As upper die shoe 26 moves downward toward lower die shoe 24, first die 60 first engages the two sheets of veneer 12 to "hold" them in position between first die 60 and fourth die 62. As upper die shoe 26 moves further downward, second die 40 cuts the sheet of veneer 12 closest to it and fourth die 62 cuts the sheet of veneer 12 closest to it. Third die 42 is positioned to hold the residue 14 from the sheet of veneer 12 closest to it, so that the cut and spliced multiple sheet 16, shown in FIG. 4, is properly formed from the two sheets of veneer 12.

It is realized that the foregoing detailed description is given primarily for clearness of understanding and the unnecessary limitations are to be understood therefrom, for modifications can be made by those skilled in the art upon reading this disclosures, and may be made without departing from the spirit of the invention and scope of the appended claims.

What is claimed is:

1. An apparatus for cutting and splicing sheets of wood veneer, comprising:

a support assembly for two pairs of dies and means to move the dies in a cutting and splicing relationship with each other;

a first pair of elongated dies in opposed cooperating relation, a first die being a holding die and being transversely moveable within a second die, said second die being a cutting die and being stationary in relationship with said first die;

a second pair of elongated dies in opposed cooperating relation, a third die being a holding die and being transversely moveable within a fourth die, said fourth die being a cutting die and being stationary in relationship with said third die;

said first and second pairs of dies being mounted in spaced parallel relationship, said first pair of dies being transversely moveable toward said second pair of dies;

a spacing between said first and second pairs of dies of sufficient thickness to receive at least two sheets of wood veneer material disposed in overlapping relationship therebetween; and means to move the dies in a cutting and splicing relationship with each other.

2. The apparatus of claim 1, wherein said support assembly for said two pairs of cutting dies and means to move the dies in a cutting and splicing relationship with each other comprises an upper die shoe, a lower die shoe, and a top support; said means to move the dies in a cutting and splicing relationship with each other being connected between said upper die shoe and said top support; said first die being attached to said upper die shoe with biasing means therebetween, said second die being fixedly attached to said upper die shoe, said third die being attached to said lower die shoe with biasing means therebetween, and said fourth die being fixedly attached to said lower die shoe.

3. The apparatus of claim 2, wherein said biasing means comprises a plurality of springs.

4. The apparatus of claim 1, wherein when said dies are moved to a cutting and splicing position, said first die is at a first horizontally displaced position equal to the thickness of one veneer sheet above said second die; said second die is at a second horizontally displaced position equal to the thickness of one veneer sheet above said fourth die; and, said third die at a third horizontally displaced position equal to the thickness of one veneer sheet below said fourth die.

5. The apparatus of claim 1, wherein said means to move the dies in a cutting and splicing relationship with each other includes a piston assembly.

6. The apparatus of claim 5, wherein said piston assembly includes a piston and a piston rod; said piston assembly attached at one end to a top support and said piston assembly attached at its opposite end to an upper die shoe.

7. The apparatus of claim 6, further comprising means to separate said first and said second pairs of dies.

8. The apparatus of claim 7, wherein said separation means comprises at least one spring connected between said top support and said upper die shoe.

9. The apparatus of claim 2, wherein said support assembly for two pairs of dies and means to move the dies in a cutting and splicing relationship with each other includes a plurality of die guide assemblies, each of said plurality of die guide assemblies connected between said upper die shoe and said lower die shoe.

10. The apparatus of claim 9, wherein each of said plurality of die guide assemblies comprises a pair of cooperating cylinders, wherein one cylinder is slidably received at least partway within the other cylinder.

11. The apparatus of claim 10, wherein said pair of cooperating cylinders have a sleeve containing bearings therebetween.

* * * * *